US010034538B1

(12) United States Patent
Masters et al.

(10) Patent No.: US 10,034,538 B1
(45) Date of Patent: Jul. 31, 2018

(54) HEIGHT-ADJUSTABLE WORK SURFACE ASSEMBLY

(71) Applicant: Sauder Woodworking Co., Archbold, OH (US)

(72) Inventors: Nolan Bruce Masters, Waldron, MI (US); Shawn Richard Sowers, Perrysburg, OH (US); Ronald Salsbury, Metamora, OH (US); Terry Wayne Armey, Napoleon, OH (US); Richard A. Nelson, Napoleon, OH (US)

(73) Assignee: SAUDER WOODWORKING CO., Archbold, OH (US)

( * ) Notice: Subject to any disclaimer, the term of this patent is extended or adjusted under 35 U.S.C. 154(b) by 0 days.

(21) Appl. No.: 15/588,177

(22) Filed: May 5, 2017

(51) Int. Cl.
*A47B 9/10* (2006.01)
*B25H 1/16* (2006.01)
*A47B 9/06* (2006.01)

(52) U.S. Cl.
CPC ..... *A47B 9/10* (2013.01); *A47B 9/06* (2013.01); *B25H 1/16* (2013.01); *A47B 2009/065* (2013.01)

(58) Field of Classification Search
CPC ..... A47B 21/0073; A47B 21/02; A47B 2200/0043; A47B 51/00; A47B 9/06; A47B 9/20; A47B 9/16; A47B 9/10; A47B 9/00; A47B 2009/003; A47B 2009/065; A47B 57/00
USPC ..... 108/136, 147; 312/306, 312, 25, 28, 29, 312/21
See application file for complete search history.

(56) References Cited

U.S. PATENT DOCUMENTS 2,516,281 A * 7/1950 Wilson ..... A47B 21/02 312/29
3,118,705 A 1/1964 Stalnacke
4,194,452 A * 3/1980 Crowther ..... A47B 9/00 108/138
4,381,714 A * 5/1983 Henneberg ..... A47B 9/10 108/146
4,469,382 A * 9/1984 Slaats ..... E05B 65/0003 312/194

(Continued)

FOREIGN PATENT DOCUMENTS

DE 2816849 * 10/1979
DE 3314388 * 5/1984

(Continued)

*Primary Examiner* — Janet Marie Wilkens
(74) *Attorney, Agent, or Firm* — Honigman Miller Schwartz and Cohn LLP; Douglas H. Siegel; Jonathan P. O'Brien

(57) ABSTRACT

A height-adjustable work surface assembly includes a base portion and a work portion, and may include a gas spring, an actuation mechanism, a rack, and a pinion. The work portion is supported by the base portion for translation along a first path of motion. The gas spring is actuatable between a locked position and an unlocked position, and is operable to apply a force on the work portion in the unlocked position to urge the work portion along the first path of motion. The actuation mechanism is coupled to the gas spring to move the gas spring from the locked to the unlocked position. The rack is supported by the work portion or the base portion and includes a first plurality of teeth. The pinion is supported by the other of the work portion and the base portion and includes a second plurality of teeth.

25 Claims, 8 Drawing Sheets

(56) References Cited

U.S. PATENT DOCUMENTS 4,651,652 A * 3/1987 Wyckoff ..... A47B 9/12 108/147
4,703,700 A 11/1987 Sema
4,790,611 A * 12/1988 Craner ..... A47B 57/00 108/147
4,850,563 A 7/1989 Grout
5,370,063 A 12/1994 Childers
5,397,111 A 3/1995 Knopp et al.
5,408,940 A * 4/1995 Winchell ..... A47B 9/06 108/10
5,450,800 A * 9/1995 Leonard ..... A47B 21/0073 108/7
5,577,804 A 11/1996 Tedesco
5,778,803 A 7/1998 Machael
5,988,029 A 11/1999 Rottermann et al.
6,224,516 B1 5/2001 Disch
6,435,111 B1 * 8/2002 Stumpf ..... A47B 9/02 108/147
6,471,311 B1 * 10/2002 Snyder ..... A47B 51/00 312/245
6,644,748 B2 11/2003 Tholkes et al.
7,007,587 B2 3/2006 Zanden
7,721,640 B2 5/2010 Lee
8,714,670 B2 * 5/2014 Kuo ..... H05K 7/1489 312/223.1
2006/0230992 A1 10/2006 Newhouse et al.
2007/0040482 A1 * 2/2007 Williams ..... A47B 9/06 312/21
2009/0102335 A1 * 4/2009 Hancock ..... A47B 21/0073 312/223.3
2011/0061570 A1 3/2011 Klinke et al.
2015/0068432 A1 * 3/2015 Wagner ..... A47B 17/02 108/3

FOREIGN PATENT DOCUMENTS

DE 10125995 A1 11/2002
DE 202016100144 * 1/2017
EP 0590211 A1 4/1994
EP 2946689 * 5/2015
FR 2490085 * 3/1982
JP 6-157 6/1994

* cited by examiner

HEIGHT-ADJUSTABLE WORK SURFACE ASSEMBLY

FIELD

The present disclosure relates to a height-adjustable work surface assembly and more particularly to a mechanism for changing and securing the position of a height-adjustable work surface.

BACKGROUND

This section provides background information related to the present disclosure and is not necessarily prior art.

Various types of desks and other work surfaces (e.g., tables, shelves, workbenches, etc.) include, or are otherwise assembled with, a lift mechanism. The lift mechanism allows a user to adjust a position of the desk relative to at least one axis. For example, some desks include a lift mechanism that allows a user to adjust and select the position (e.g., height) of the desk relative to a y-axis. Other desks include a lift mechanism that allows a user to adjust and select the position (e.g., height and depth) of the desk relative to a y-axis and an x-axis. Desks may also include lock mechanisms that allow the user to lock the desk in the selected position relative to the axes.

While known desks and work surfaces, including lift and lock mechanisms, have proven useful for their intended purposes, a need for continuous improvement in the pertinent art remains.

SUMMARY

This section provides a general summary of the disclosure, and is not a comprehensive disclosure of its full scope or all of its features.

One aspect of the disclosure provides a height-adjustable work surface assembly. The assembly may include a base portion, a work portion, a gas spring, an actuation mechanism, a rack, and a pinion. The work portion may be supported by the base portion for translation along a first path of motion. The gas spring may be operable in a first mode of operation and a second mode of operation, and may be operable to apply a force on the work portion in the second mode of operation to urge or push the work portion along the first path of motion. The actuation mechanism may be operably coupled to the gas spring to selectively transition the gas spring from the first mode of operation to the second mode of operation. The rack may be supported by one of the work portion or the base portion and may include a first plurality of teeth. The pinion may be supported by the other of the work portion and the base portion and may include a second plurality of teeth configured to engage the first plurality of teeth.

Implementations of the disclosure may include one or more of the following optional features. In some implementations, the first path of motion defines an angle relative to the vertical direction. The angle may be between about zero degrees and about forty-five degrees. In some implementations, the angle may be between about one degree and about forty-five degrees; and in another implementation, the angle is equal to about five degrees.

In some implementations, the base portion includes a primary track member and the work portion includes a secondary track member supported for translation relative to the primary track member along the first path of motion.

In some implementations, the actuation mechanism includes a handle translatably coupled to the work portion. The actuation mechanism may include a cable assembly operably coupled to the handle and the gas spring. The cable assembly may include a housing and a cable translatably disposed within the housing. The actuation mechanism may include a mounting member having an aperture. The cable may be translatably disposed within the aperture. In some implementations, the housing is coupled to the mounting member.

In some implementations, the gas spring is pivotally coupled to the base portion and the work portion.

In some implementations, the pinion is rotatably coupled to the other of the work portion and the base portion.

In some implementations, the assembly includes a tensioner having a housing and an plunger supported by the housing for translation along a second path of motion relative to the housing. The second path of motion may be transverse to the first path of motion.

In some implementations, the pinion is rotatably coupled to the plunger.

In some implementations, the plunger includes a base portion and a button portion biasingly supported by the base portion. The housing may define an aperture configured to receive the button portion to prevent translation of the plunger relative to the housing along the second path of motion.

In some implementations, the assembly includes an axle coupled to the pinion for rotation therewith. The plunger may define a hub rotatably receiving the axle.

In some implementations, the assembly includes a shield concentrically disposed about the pinion.

Another aspect of the disclosure provides a height-adjustable work surface assembly. The assembly may include a base portion, a work portion, a primary track member, a secondary track member, a gas spring, and an actuation mechanism. The work portion may be supported by the base portion. The primary track member may be coupled to one of the work portion or the base portion. The secondary track member may be coupled to the other of the work portion and the base portion and supported for translation relative to the primary track member along a first path of motion. The gas spring may be operable in a first mode of operation and a second mode of operation and may be operable to apply a force on the work portion in the second mode of operation to urge the work portion along the first path of motion. The actuation mechanism may be operably coupled to the gas spring to selectively move the gas spring from the first mode of operation to the second mode of operation. The first path of motion may extend in a direction transverse to the vertical direction.

Yet another aspect of the disclosure provides a height-adjustable work surface assembly. The assembly may include a base portion, a work portion, a primary track member, a secondary track member, a rack, and a pinion. The work portion may be supported by the base portion. The primary track member may be coupled to one of the work portion or the base portion. The secondary track member may be coupled to the other of the work portion and the base portion and supported for translation relative to the primary track member along a first path of motion. The rack may be supported by one of the work portion or the base portion and may include a first plurality of teeth. The pinion may be supported by the other of the work portion and the base portion and may include a second plurality of teeth configured to engage the first plurality of teeth.

Implementations of this aspect of the disclosure may include one or more of the following features. In some implementations, the assembly includes a gas spring and an actuation mechanism. The gas spring may be operable in a first mode of operation and a second mode of operation and operable to apply a force on the work portion in the second mode of operation to urge the work portion along the first path of motion. The actuation mechanism may be operably coupled to the gas spring to selectively move the gas spring from the first mode of operation to the second mode of operation. The first path of motion may extend in a direction transverse to the vertical direction.

In some implementations, the pinion is translatably coupled to the other of the work portion and the base portion.

Yet another aspect of the disclosure provides a rack and pinion assembly. The rack and pinion assembly may include a rack and a tensioner subassembly. The rack may include a first plurality of teeth. The tensioner subassembly may include a housing, a plunger, and a pinion. The housing may include a channel and a first locking feature. The plunger may be translatably disposed within the channel and include a second locking feature configured to engage the first locking feature. The pinion may be rotatably coupled to the plunger and include a second plurality of teeth configured to engage the first plurality of teeth.

Implementations of this aspect of the disclosure may include one or more of the following features. In some implementations, the second locking feature includes a moveable button. The first locking feature may define an aperture configured to receive the button to prevent translation of the plunger relative to the housing.

In some implementations, the assembly includes an axle coupled to the pinion for rotation therewith. The plunger may define a hub rotatably receiving the axle. The plunger may include a shield concentrically disposed about the hub.

In some implementations, a height-adjustable work surface assembly may include the rack and pinion assembly and may further include a base portion and a work portion supported by the base portion for translation along a first path of motion. The rack may be supported by one of the work portion or the base portion. The tensioner subassembly may be supported by the other of the work portion and the base portion. The first path of motion may extend in a direction transverse to a vertical direction.

Another aspect of the present disclosure provides a method of assembling a height-adjustable work surface assembly. The method may include coupling a primary track member to a secondary track member for translation relative to the secondary track member along a first path of motion. The primary track member may be coupled to one of a work portion or a base portion of the height-adjustable work surface assembly. The secondary track may be coupled to the other of the work portion or the base portion of the height-adjustable work surface assembly. The method may also include engaging a first pinion with a first rack. The first pinion may be supported by the work portion. The first rack may be supported by the base portion. The method may further include engaging a second pinion with a second rack, the second pinion supported by the work portion, the second rack supported by the base portion.

Implementations of this aspect of the disclosure may include one or more of the following features. In some implementations, engaging the first pinion with the first rack includes engaging a plurality of pinion teeth with a plurality of rack teeth.

In some implementations, engaging the first pinion with the first rack occurs substantially simultaneously with engaging the first pinion with the first rack.

In some implementations, engaging the first pinion with the first rack includes translating the first pinion relative to the first rack along a second path of motion transverse to the first path of motion.

In some implementations, the first pinion is supported for translation by a first housing. The method may further including unlocking the first pinion relative to the first housing.

The details of one or more implementations of the disclosure are set forth in the accompanying drawings and the description below. Other aspects, features, and advantages will be apparent from the description and drawings, and from the claims.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1A:
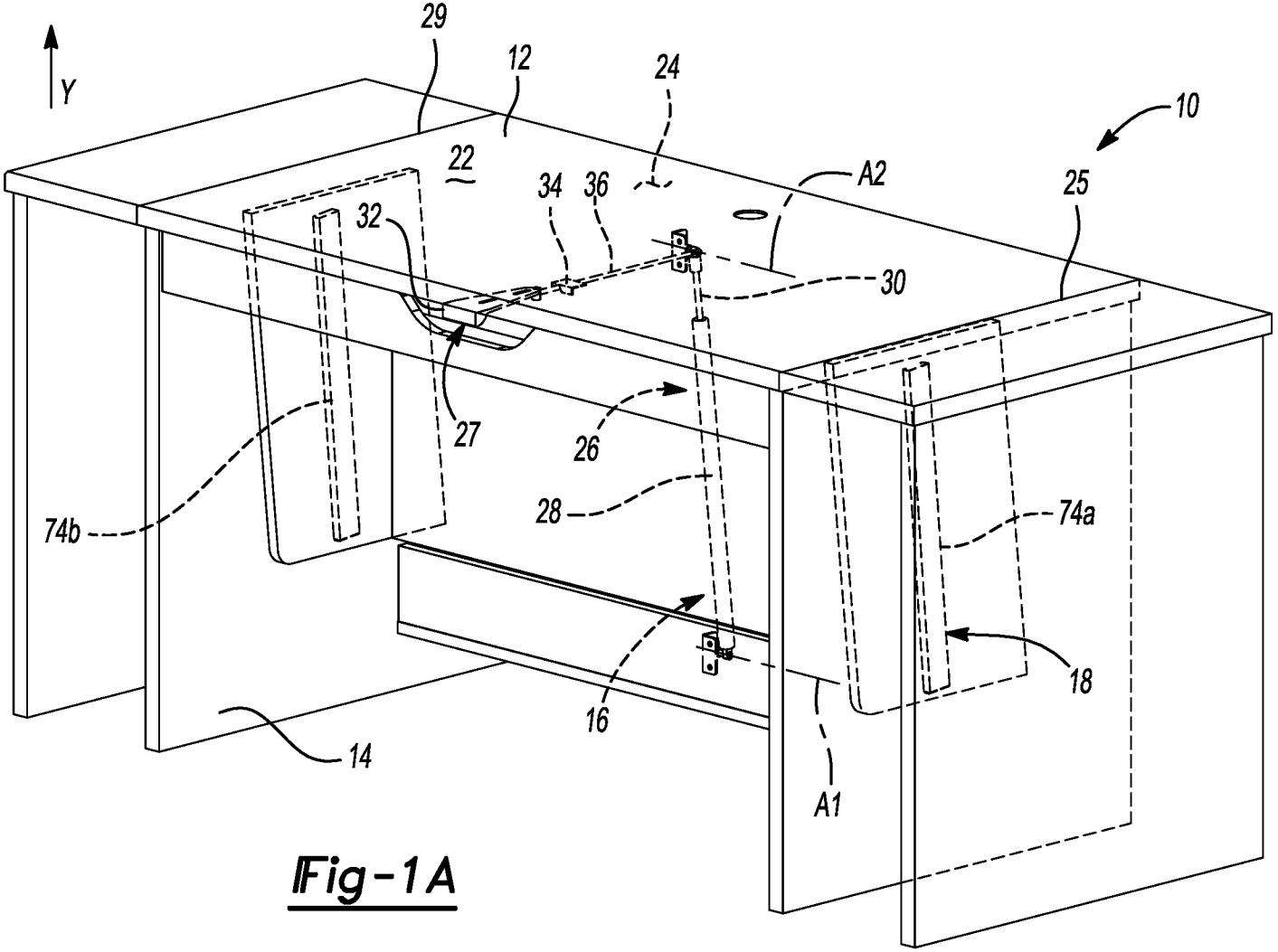
FIG. 1A is a front perspective view of a height-adjustable work surface assembly in a first position in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise.

The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The terms "substantially" and "about" as used herein generally refer to the inherent degree of uncertainty that may be attributed to a comparison, value, measurement, or other representation. These terms are also utilized herein to represent the degree by which a comparison, value, measurement, or other representation may vary from a stated reference without resulting in a change in the basic function of the subject matter at issue. Unless otherwise defined herein, the terms "substantially" and "about" mean that the comparison, value, measurement, or other representation may fall within 20% of the stated reference.

With reference to FIGS. 1A-1D, a height-adjustable work surface assembly 10 is provided. The assembly 10 may include a work portion 12, a base portion 14, a lift assembly 16, a guide assembly 18, and an alignment assembly 20. The work portion 12 may include a structure having any shape or configuration including a work surface 22, a support surface 24, a first side 25, and a second side 29. The support surface 24 may be opposite the work surface 22, and the second side 29 may be opposite the first side 25. For example, the work surface 22 may define an upper or top surface of the work portion 12, and the support surface 24 may define a lower or bottom surface of the work portion 12. In this regard, while the work portion 12 is shown and described herein as being a desk, it will be appreciated that the work portion 12 may include other types of work members (e.g., a table, a bench, a shelf, etc.) within the scope of the present disclosure. The base portion 14 may include a leg(s) or other structure supporting the work portion 12 for translation along a path of motion. In some implementations, the base portion 14 may include an other work portion, such as, the ground, a floor, or any other structure or surface from which movement and a position of the work portion 12 relative to a vertical direction Y can be measured. In one embodiment, the vertical direction Y is perpendicular to the other work portion, i.e., perpendicular to the ground or floor. In another embodiment, the vertical direction Y is perpendicular to or substantially perpendicular to the other work portion.

Figure 1B:
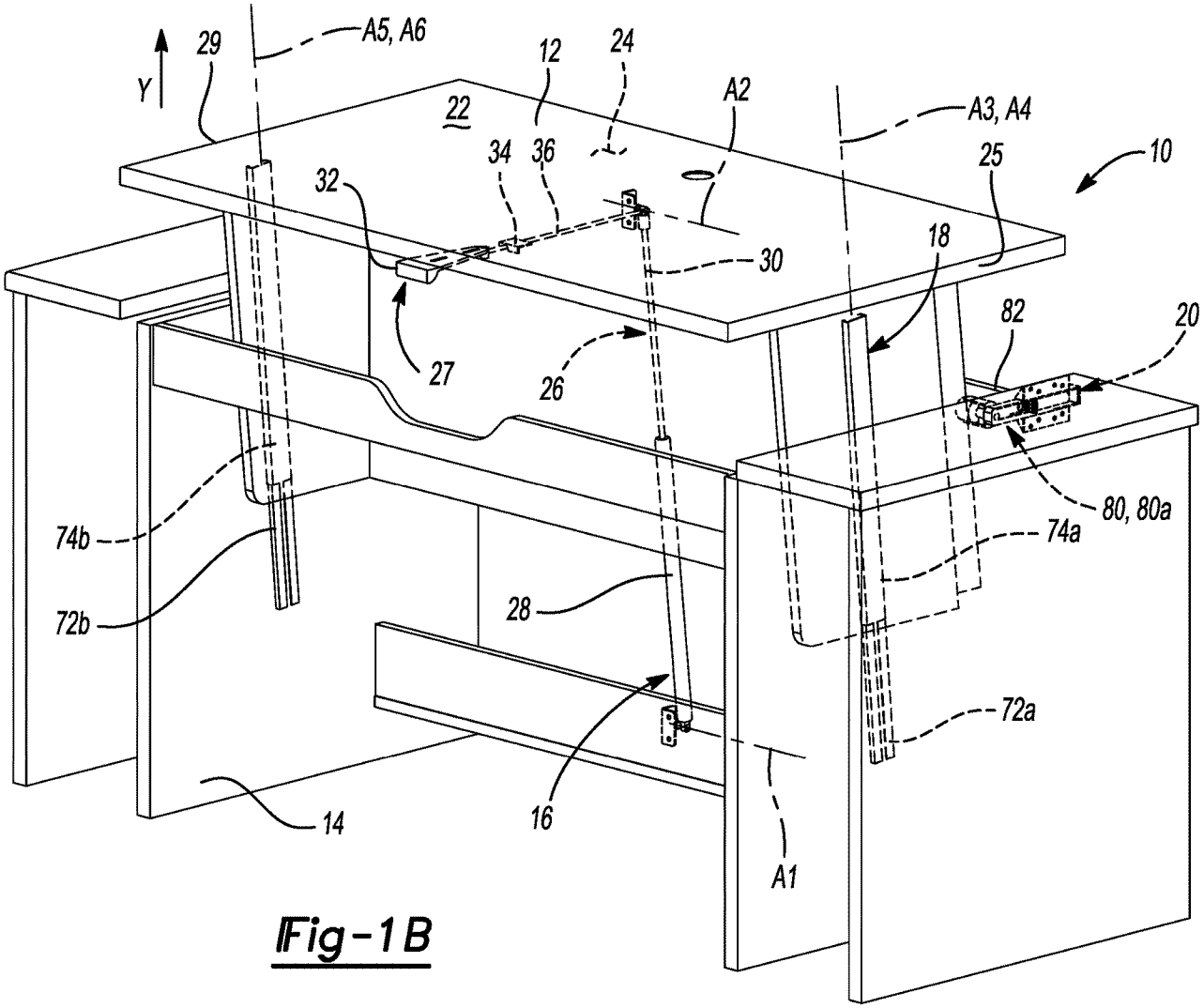
FIG. 1B is a front perspective view of the height-adjustable work surface assembly of FIG. 1A in a second position in accordance with the principles of the present disclosure.

With reference to FIGS. 1A and 1B, the lift assembly 16 may include a lift mechanism 26 and an actuation mechanism 27. The lift mechanism 26 may be disposed between the first and second sides 25, 29 of the work portion 12. For example, the lift mechanism 26 may be centered between the first and second sides 25, 29 of the work portion 12. In some implementations, the lift mechanism 26 includes a gas spring. Accordingly, the lift mechanism 26 may be referred to herein as the "gas spring 26." The gas spring 26 may include a primary member 28 and a secondary member 30 translatably coupled to the primary member 28. In this regard, the secondary member 30 may be operable in a first mode of operation in which the secondary member 30 is fixed relative to the primary member 28, and a second mode of operation in which the position of the secondary member 30 is translatable relative to the primary member 28. In some implementations, the gas spring 26 includes a biasing member, such as a gas (e.g., nitrogen), for example, that urges the secondary member 30 to translate relative to the primary member 28 in the second mode of operation, and supports, or otherwise fixes the position of, the secondary member 30 relative to the primary member 28 in the first mode of operation. In this regard, in the first mode of operation, the gas spring 26 may function as a safety mechanism by preventing the work portion 12 from translating or otherwise moving relative to the base portion 14, while, in the second mode of operation, the gas spring 26 may allow for infinitesimal movements of the secondary member 30 relative to the primary member 28.

The primary member 28 may be supported by, or otherwise coupled to, the base portion 14 of the assembly 10, and the secondary member 30 may be supported by, or otherwise coupled to, the work portion 12. Accordingly, translation of the secondary member 30 relative to the primary member 28 may cause the primary and secondary members 28, 30 to apply opposing forces on the work and base portions 12, 14, respectively, and thereby cause the work portion 12 to translate relative to the base portion 14. In some implementations, the primary member 28 is pivotally coupled to the base portion 14 for rotation about an axis A1, and the secondary member 30 is pivotally coupled to the work portion 12 for rotation about an axis A2. The axis A2 may be substantially parallel to the axis A1 and substantially perpendicular to the vertical direction Y. Accordingly, as will be explained in more detail below, when the secondary member 30 translates relative to the primary member 28, and the work portion 12 translates relative to the base portion 14, the primary member 28 may pivot about the axis A1 relative to the base portion 14 and the secondary member 30 may pivot about the axis A2 relative to the work portion 14.

Figure 2:
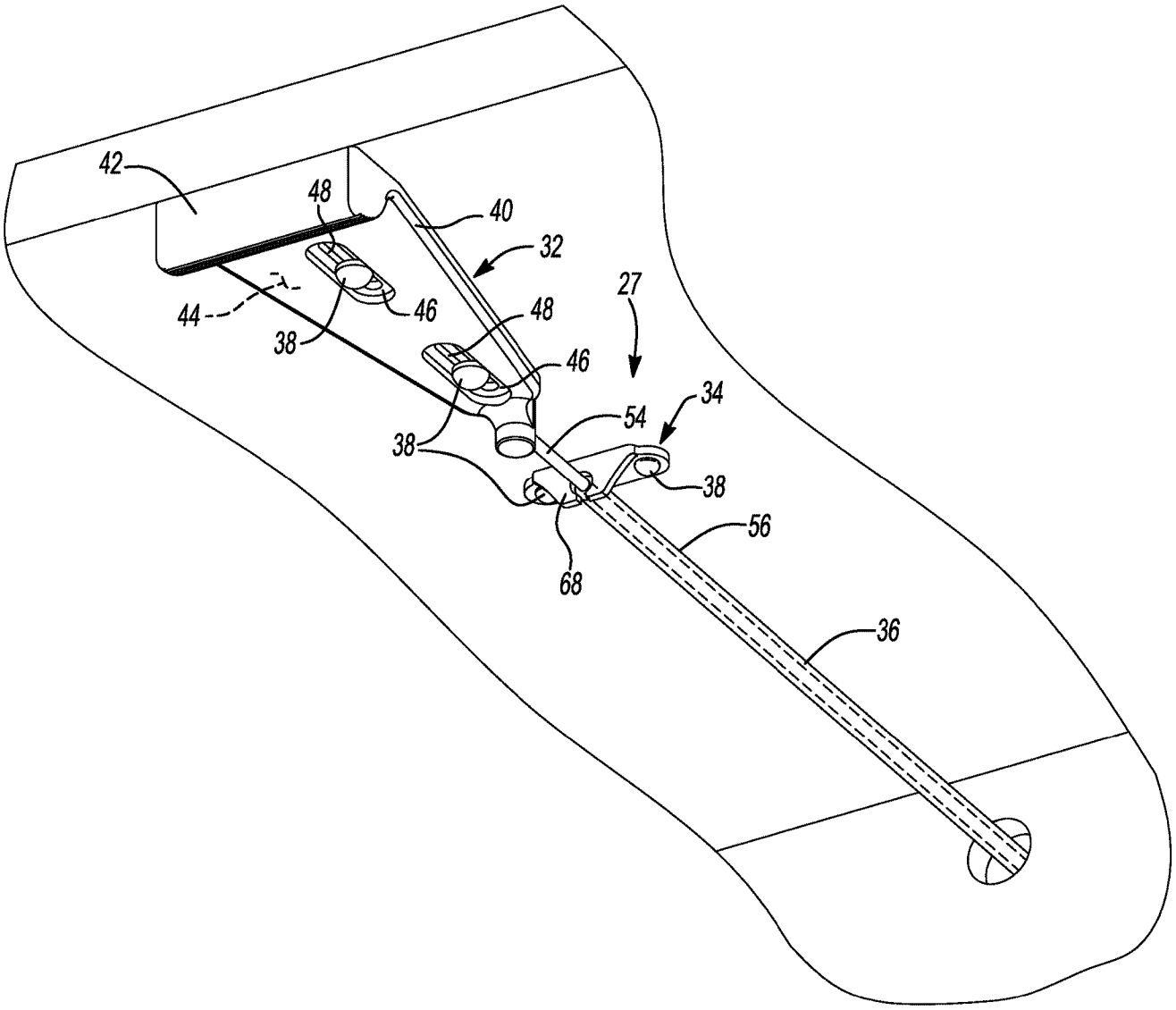
FIG. 2 is a perspective view of an actuation mechanism of a height-adjustable work surface assembly in accordance with the principles of the present disclosure.

With reference to FIG. 2, the actuation mechanism 27 may include a handle 32, a bracket 34, a cable subassembly 36, and one or more fasteners 38. As will be described in more detail below, the actuation mechanism 27 may be operably coupled to the lift mechanism 26 to allow a user to selectively transition the lift mechanism 26 from the first mode of operation (e.g., primary member 28 fixed relative to secondary member 30) to the second mode of operation (e.g., primary member 28 translatable relative to secondary member 30).

The handle 32 may include a base portion 40 and a pull portion 42 extending transversely from the base portion 40. The base portion 40 may include a slide surface 44, one or more countersink features 46 formed in a surface opposite the slide surface 44, and one more through holes 48 extending through both the slide surface 44 and the surface opposite the slide surface 44. In some implementations, the slide surface 44 has a planar construct such that, in the assembled configuration, the slide surface 44 engages, and is readily translatable relative to, the support surface 24 of the work portion 12.

The countersink features 46 and the through holes 48 may each define an oblong (e.g., elliptical, stadium, rectangular, etc.) shape or construct. While the handle 32 is illustrated as having two countersink features 46 and two through holes 48, it will be appreciated that the handle 32 may include more or less than two countersink features 46 and through holes 48 within the scope of the present disclosure. For example, the number of countersink features 46 may equal the number of through holes 48. In this regard, each through hole 48 may be concentrically disposed within a corresponding countersink feature 46.

The fasteners 38 may include a screw, a bolt, a nail, or other suitable mechanical fastener including a shank (not shown) and a head having a larger cross-sectional area than the shank. While the actuation mechanism 27 is illustrated as having two fasteners 38, it will be appreciated that the actuation mechanism 27 may include more or less than two fasteners 38 within the scope of the present disclosure. For example, the number of fasteners 38 may equal the number of countersink features 46 and the number of through holes 48. In this regard, in the assembled configuration, the shank of each fastener 38 may be disposed within a corresponding through hole 48 and in the work portion 12 of the assembly 10, and the head of each fastener 38 may be disposed within a corresponding countersink feature 46. Accordingly, the fasteners 38 may secure the handle 32 to the work portion 12, while allowing the handle 32 to translate relative to the fasteners 38 (e.g., the shank translates within the through hole 48) and the work portion 12.

The cable subassembly 36 may include a cable 54 and a cover or housing 56. It will be appreciated that the cable 54 may include various other suitable configurations within the scope of the present disclosure, such as a wire, a cord, or a string, for example. The housing 56 may include a tubular construct such that in the assembled configuration, the cable 54 may be translatably disposed within the housing 56. A first end of the cable 54 may be coupled to the handle 32 and an opposite second end of the cable 54 may be coupled to the lift mechanism 26. In particular, the second end of the cable 54 may be coupled to a release mechanism (not shown) of the lift mechanism 26 that is operable to move the secondary member 30 from the first mode of operation to the second mode of operation.

The bracket 34 may include an attachment feature 68 and may be coupled to the work portion 12 of the assembly 10. The attachment feature 68 may be coupled to the cable subassembly 36. In particular, the attachment feature 68 may be coupled to the housing 56. In some implementations, the attachment feature 68 defines a channel sized to receive the housing 56. Accordingly, the bracket 34 may be operable to fix the location of the housing 56 relative to the assembly 10, while allowing the cable 54 to translate with the handle 32 relative to the housing 56, the bracket 34, and the work portion 12 of the assembly 10.

With reference to FIG. 1B, the guide assembly 18 may include a first track 72*a* defining a longitudinal axis A3, a first carriage 74*a* defining a longitudinal axis A4, a second track 72*b* defining a longitudinal axis A5, and a second carriage 74*b* defining a longitudinal axis A6. The first track 72*a* may receive the first carriage 74*a* such that the longitudinal axis A3 is substantially parallel to the longitudinal axis A4, and the second track 72*b* may receive the second carriage 74*b* such that the longitudinal axis A5 is substantially parallel to the longitudinal axis A6. In some implementations, the longitudinal axes A3, A4, A5, A6 are all parallel to one another. The first and second carriages 74*a*, 74*b* may be translatably disposed within a portion of the first and second tracks 72*a*, 72*b*, respectively, such that the first and second carriages 74*a*, 74*b* are translatable relative to the first and second tracks 72*a*, 72*b* along the longitudinal axes A3, A4, A5, A6.

In the assembled configuration, the tracks 72*a*, 72*b* may be coupled to one of the work portion 12 or the base portion 14 of the assembly 10, and the carriages 74*a*, 74*b* may be coupled to the other of the work portion 12 and the base portion 14 of the assembly 10. For example, the tracks 72*a*, 72*b* may be coupled to first and second sides, respectively, of the base portion 14 and the carriages 74*a*, 74*b* may be coupled to the first and second sides 25, 29, respectively, of the work portion 12. In some implementations, the gas spring 26 is centered between the first and second carriages 74*a*, 74*b*. As will be described in more detail below, the work portion 12 may move with the carriages 74*a*, 74*b* relative to the tracks 72*a*, 72*b* and the base portion 14. For example, translation of the carriages 74*a*, 74*b* relative to the tracks 72*a*, 72*b* may cause the work portion 12 to translate relative to the base portion 14.

In some implementations, the tracks 72*a*, 72*b* and the carriages 74*a*, 74*b* are coupled to the base portion 14 and the work portion 12, respectively, such that the longitudinal axes A3, A4, A5, A6 extend in a direction transverse to (i.e., offset from) the vertical direction Y. For example, as illustrated in FIG. 1D, the longitudinal axes A3, A4, A5, A6 may define an angle $\alpha$ relative to the vertical direction Y. The angle $\alpha$ may be between about zero degrees and about forty-five degrees. In some implementations, the angle $\alpha$ is equal to zero degrees, which can allow for the use of a smaller (e.g., shorter length) and less expensive gas spring 26. In some implementations, the angle $\alpha$ may be between about one degree and about forty-five degrees; and in another implementation the angle $\alpha$ is equal to about five degrees. The angle $\alpha$ may reduce the force of the work portion 12 in a direction extending substantially parallel to the longitudinal axes A3, A4, A5, A6 and, therefore, reduce the amount of force needed to move the work portion 12 relative to the base portion 14 along the longitudinal axes A3, A4, A5, A6. Accordingly, the angle $\alpha$ may allow for the use of a less powerful gas spring 26 for moving the work portion 12 relative to the base portion 14. In some examples, during use, the user utilizes the assembly 10 from the side on which the handle 32 is located. Accordingly, movement of the work portion 12 relative to the base portion 14 along the longitudinal axes A3, A4, A5, A6 may move the work portion 12 towards the user.

Figure 1C:
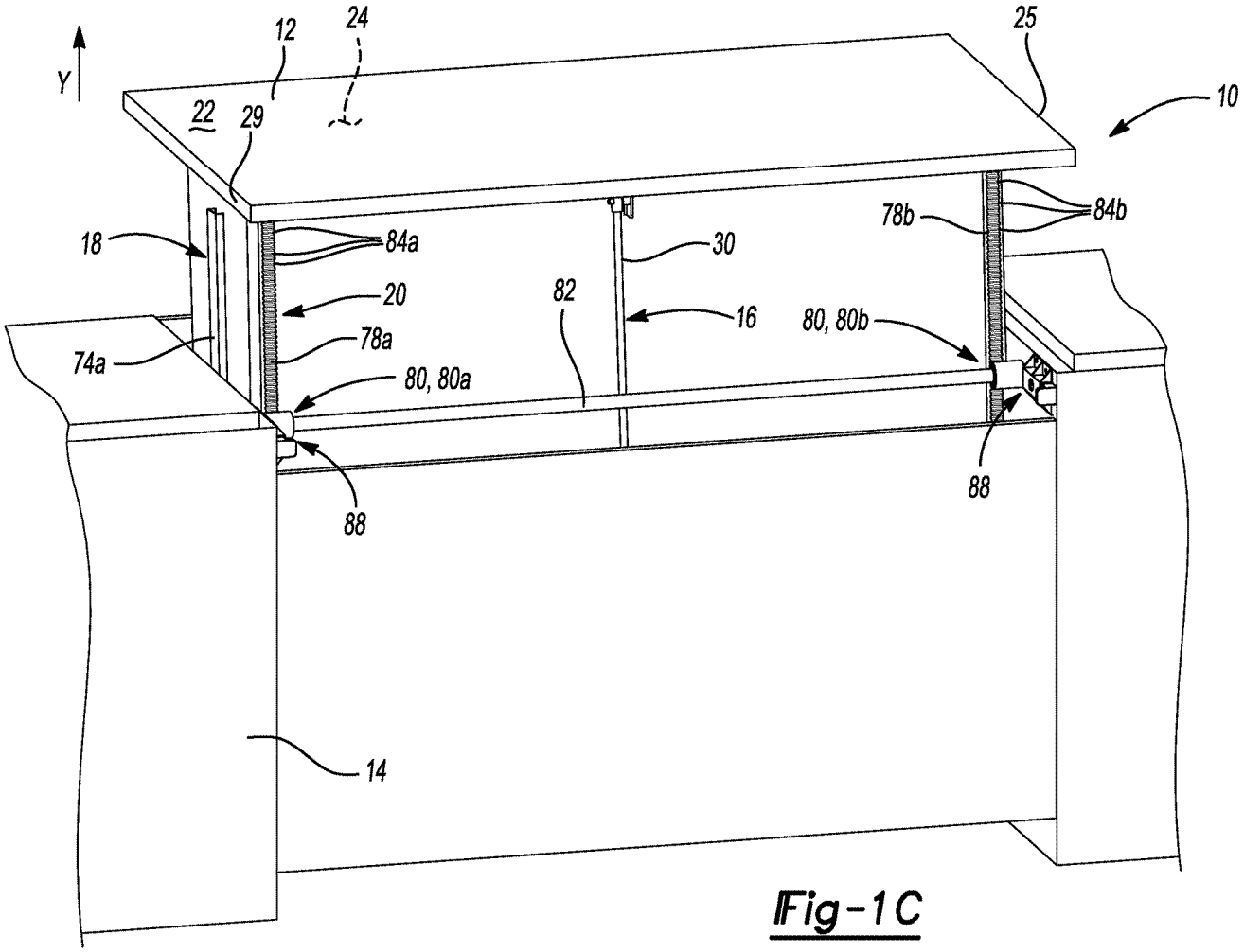
FIG. 1C is a rear perspective view of the height-adjustable work surface assembly of FIG. 1A in the second position.
Figure 1D:
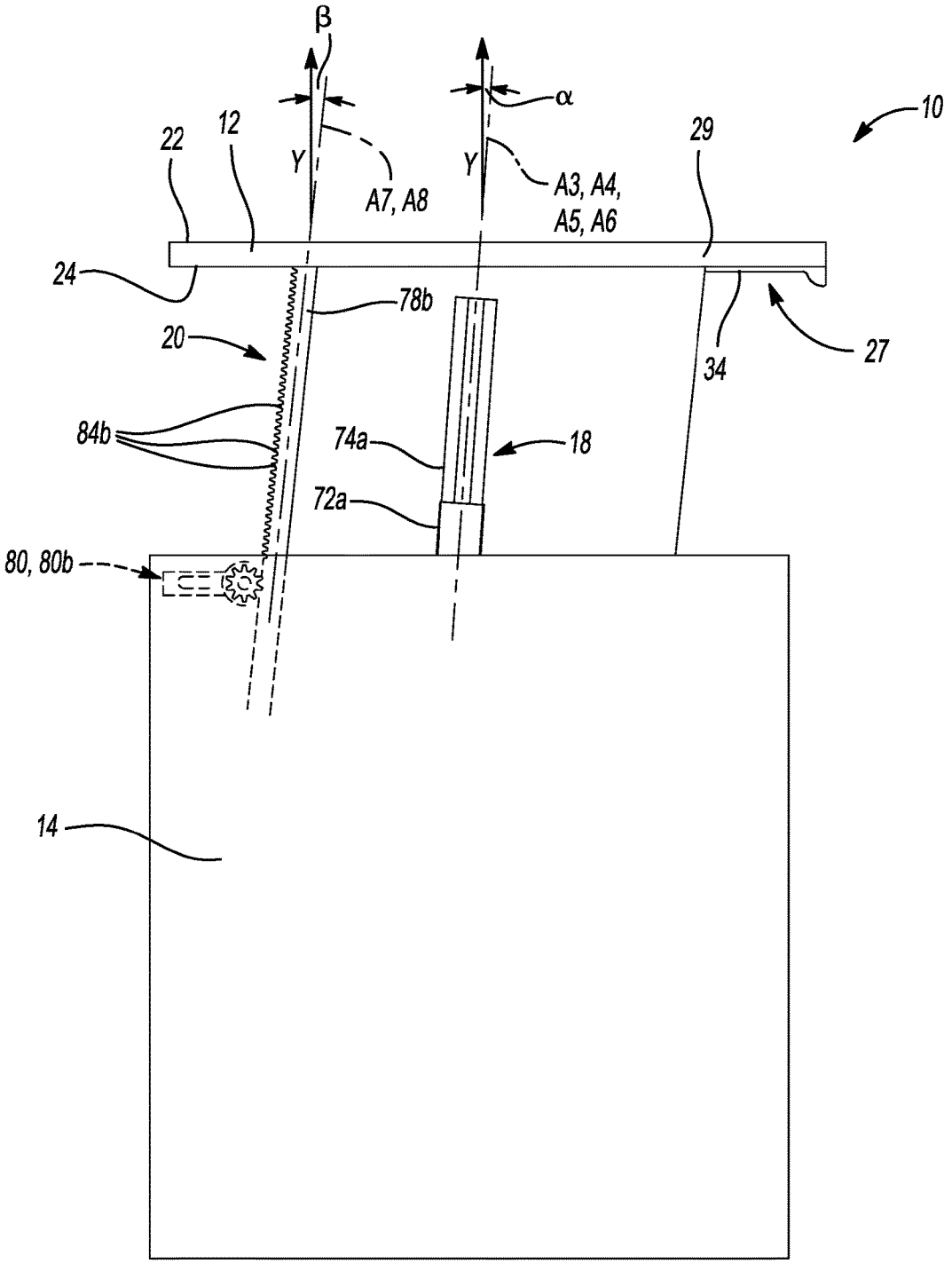
FIG. 1D is a side view of the height-adjustable work surface assembly of FIG. 1A in the second position.
Figure 3:
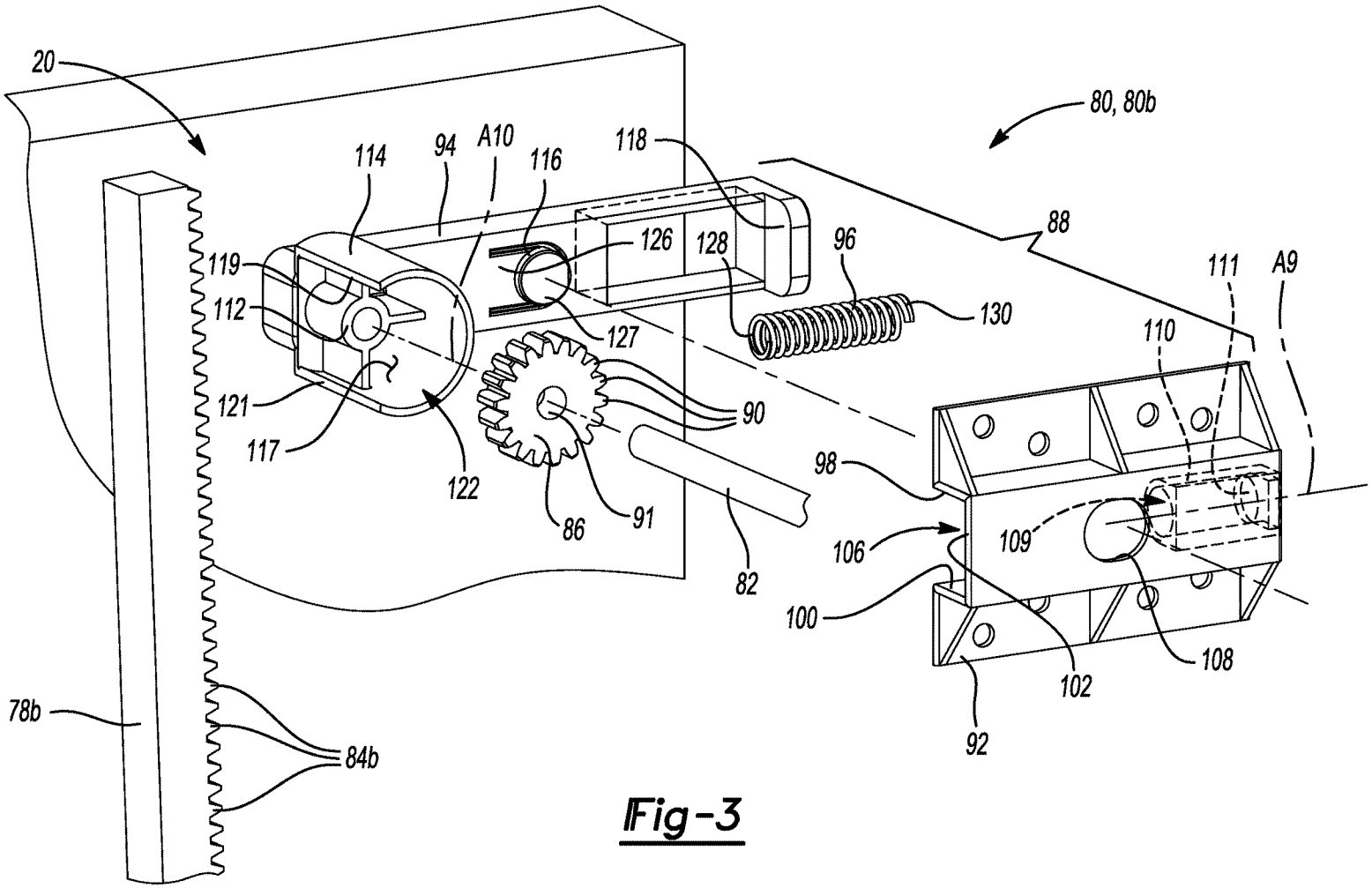
FIG. 3 is an exploded view of an alignment assembly of a height-adjustable work surface assembly in accordance with the principles of the present disclosure.

With reference to FIG. 1C, the alignment assembly 20 may include a first rack 78*a*, a first pinion subassembly 80*a*, a second rack 78*b*, a second pinion subassembly 80*b*, and an axle 82. As illustrated in FIGS. 1C, 1D, and 3, the first rack 78*a* may define a longitudinal axis A7 and include a plurality of teeth 84*a* extending along the longitudinal axis A7. The second rack 80*a* may define a longitudinal axis A8 and include a plurality of teeth 84*b* extending along the longitudinal axis A8. In the assembled configuration, the racks 78*a*, 78*b* may be coupled to one of the work portion 12 or the base portion 14 of the assembly 10. For example, the racks 78*a*, 78*b* may be coupled to first and second sides, respectively, of the work portion 12 such that the longitudinal axes A7, A8 extend in a direction transverse to the vertical direction Y. For example, as illustrated in FIG. 1D, the longitudinal axes A7, A8 may define an angle β relative to the vertical direction Y. The angle β may be between about one degree and about forty-five degrees. In some implementations, the angle β is equal to, or substantially equal to, five degrees. In this regard, the angle β may be equal to, or substantially equal to, the angle α.

The first pinion subassembly 80*a* may be substantially similar to the second pinion subassembly 80*b*. Accordingly, references herein to the pinion assembly 80 will be understood to apply equally to the first pinion subassembly 80*a* and the second pinion subassembly 80*b*, except as otherwise provided herein.

Figure 4A:
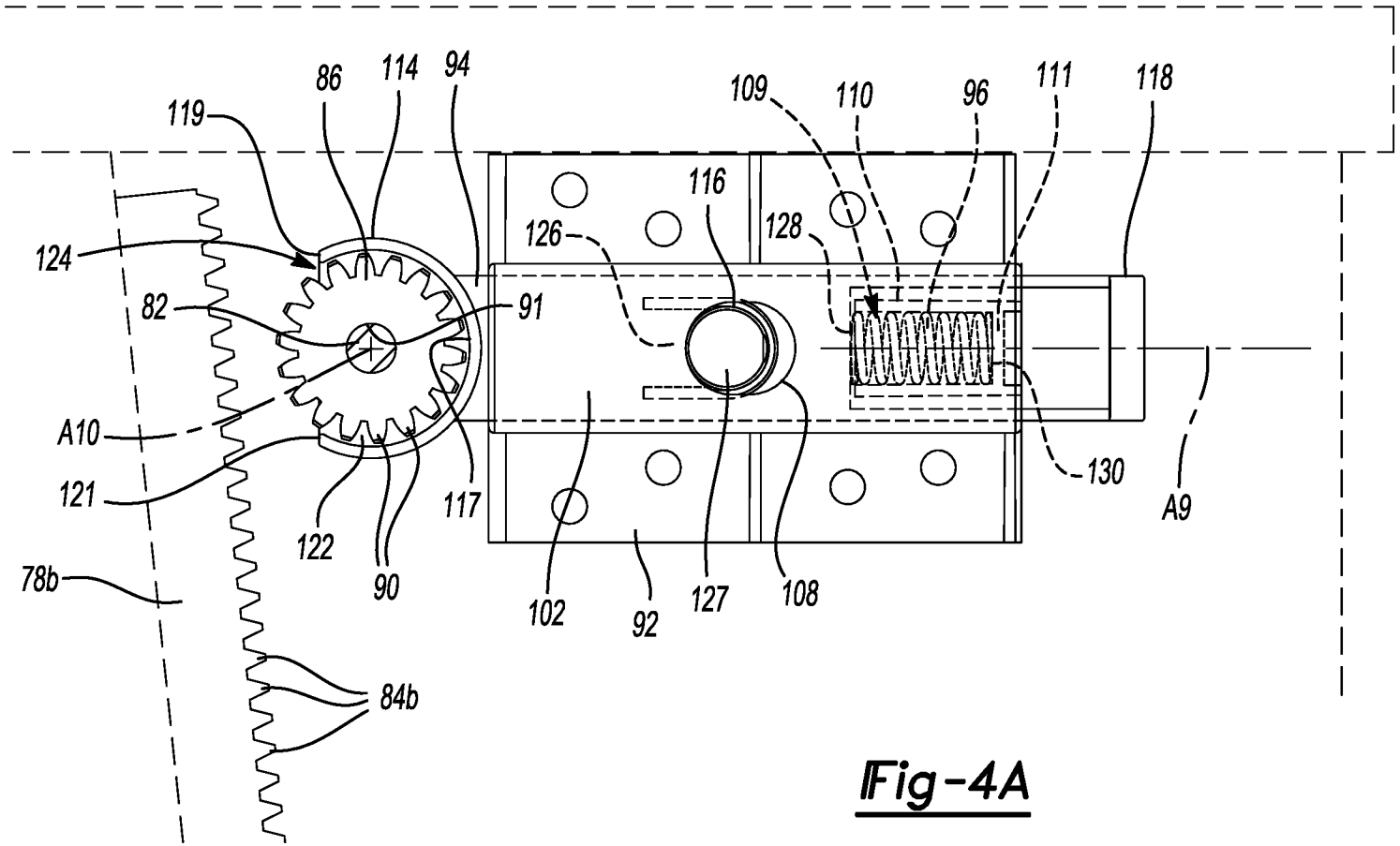
FIG. 4A is a side view of the alignment assembly of FIG. 3 in a locked position in accordance with the principles of the present disclosure.
Figure 4B:
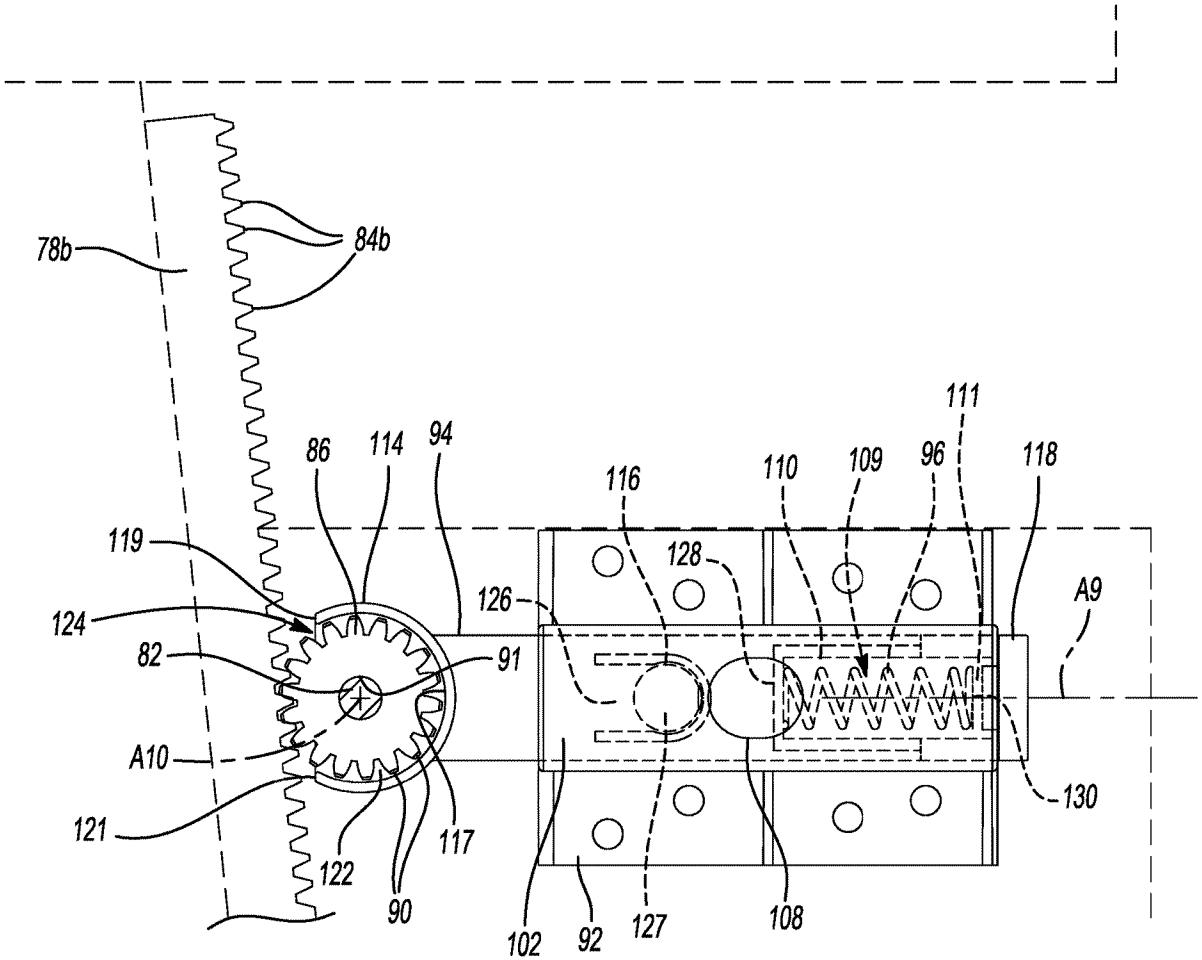
FIG. 4B is a side view of the alignment assembly of FIG. 3 in an unlocked position in accordance with the principles of the present disclosure.

With reference to FIGS. 3-4B, the pinion subassembly 80 may include a pinion 86 and a tensioner 88. First pinion subassembly 80*a* may include a pinion 86*a* and a tensioner 88*a* and second pinion subassembly 80*b* may include a pinion 86*b* and a tensioner 88*b*. The pinion 86*a* may define a ring gear having a plurality of teeth 90*a* disposed about an aperture 91*a* (e.g., a through hole) and the pinion 86*b* may define a ring gear having a plurality of teeth 90*b* disposed about an aperture 91*b*. The teeth 90*a*, 90*b* may be sized and shaped to mate with the teeth 84*a*, 84*b* of the racks 78*a*, 78*b*.

The tensioner 88 may include a housing 92, a plunger 94, and a biasing member 96. In one embodiment, tensioners 88*a*, 88*b* may include housings 92*a*, 92*b*, plungers 94*a*, 94*b*, and biasing members 96*a*, 96*b*, respectively. The housing 92 may include an upper wall 98, a lower wall 100 opposite the upper wall 98, and a side wall 102 extending between the upper wall 98 and the lower wall 100. The upper, lower, and side walls 98, 100, 102, may define a channel 106 extending along an axis A9. In this regard, the axis A9 may extend in a direction substantially parallel to the upper, lower, and side walls 98, 100, 102. The side wall 102 may include a first locking feature 108 operably communicating with the channel 106 and a biasing member-receiving feature 110 disposed within the channel 106. The first locking feature 108 may include one of a detent (e.g., a button) or an aperture (e.g., a through hole). The biasing member-receiving feature 110 may include a substantially cylindrical chamber 109 and a wall 111. The wall 111 may be disposed at an end of the cylindrical chamber 109.

The plunger 94 may include a hub 112, a shield 114, a second locking feature 116, and a handle 118. In one embodiment, plungers 94, 94*b* may include hubs 112*a*, 112*b* shields 114*a*, 114*b*, second locking features 116*a*, 116*b* and handles 118*a*, 118, respectively. The hub 112 may be concentrically disposed about an axis A10. In some implementations, the hub 112 defines an aperture sized and shaped to receive the axle 82 for rotation about the axis A10. The shield 114 may be concentrically disposed about the hub 112. In some implementations, an inner surface 117 of the shield 114 extends from a proximal end 119 to a distal end 121 about the axis A10 to define a chamber 122 having an opening 124. The proximal and distal ends 119, 121 may extend in a direction substantially parallel to the axis A10. The chamber 122 may be sized and shaped to receive the pinion 86 for rotation therein such that a portion of the pinion 86 extends through the opening 124 and beyond the proximal and distal ends 119, 121 in a direction transverse to the axis A10.

The second locking feature 116 may include one of a detent (e.g., a button) or an aperture sized and shaped to engage the first locking feature 108. In this regard, in some implementations, the second locking feature 116 includes an arm portion 126 moveably and biasingly coupled to the plunger 94, and a detent portion 127 coupled to the arm portion 126, while the first locking feature 108 defines an aperture sized and shaped to receive the detent portion 127 in a locked position. As will be explained in more detail below, the detent portion 127 may be moveable in a direction substantially parallel to the axis A10 by flexing the arm portion 126 relative to a remaining portion of the plunger 94, such that a user can move the second locking feature 116 from a locked position, in which the second locking feature 116 is engaged with the first locking feature 108, to an unlocked position, in which the second locking feature 116 is disengaged from the first locking feature 108.

The handle 118 may be disposed on an end of the plunger 94 opposite the shield 114. As will be explained in more detail below, the handle 118 may allow a user to translate the plunger 94 relative to the housing 92 within the channel 106.

The biasing member 96 may include a coil spring or other suitable device operable to move the plunger 94 relative to the housing 92. For example, in some implementations, the biasing member 96 includes a helical compression spring having a proximal end 128 and a distal end 130 opposite the proximal end 128.

As illustrated in FIGS. 4A and 4B, in the assembled configuration, the housing 92 of the first pinion subassembly 80*a* may be coupled to a first side of the base portion 14, and the housing 92 of the second pinion subassembly 80*b* may be coupled to a second side of the base portion 14 such that the axis A9 of the channel 106 extends in a direction transverse to the vertical direction Y. For example, in the assembled configuration, the axis A9 of the channel 106 may extend in a direction substantially perpendicular to the vertical direction Y. The plunger 94 may be translatably disposed within the channel 106 of the housing 92, and the biasing member 96 may be disposed within the biasing member-receiving feature 110 (e.g., within the chamber 109) such that the proximal end 128 of the biasing member 96 engages the plunger 94 and the distal end 130 of the biasing member 96 engages the housing 92 (e.g., the wall 111). The axle 82 may be disposed within (i) the apertures 91*a*, 91*b* of the pinions 86*a*, 86*b* of the first and second pinion subassemblies 80*a*, 80*b* and (ii) the hubs 112*a*, 112*b* of the plungers 94*a*, 94*b* of the first and second pinion subassemblies 80*a*, 80*b*. In particular, the axle 82 may be fixed for rotation with the pinions 86*a*, 86*b* and rotatably disposed within the hubs 112*a*, 112*b* of plungers 94*a*, 94*b*, such that rotation of the axle 82 about the axis A10 causes the pinions 86*a*, 86*b* to synchronously rotate about the axis A10 with respect to each other.

During assembly of the height-adjustable work surface assembly 10, the user may lock the detent portion 127 of the plunger 94 within the locking feature 108 of the housing 92 to assist in aligning the pinions 86*a*, 86*b* with the racks 78*a*, 78*b*. Upon aligning the pinions 86*a*, 86*b* with the racks 78*a*, 78*b*, the user may remove the detent portion 127 of the plunger 94 from the locking feature 108 of the housing 92, such that the biasing member 96 causes the plunger 94 to translate along the axis A9 until the teeth 90*a*, 90*b* of the pinions 86*a*, 86*b* engage the teeth 84*a*, 84*b* of the racks 78*a*, 78*b*. Engaging the teeth 90*a*, 90*b* of the pinions 86*a*, 86*b* with the teeth 84*a*, 84*b* of the racks 78*a*, 78*b* helps to align the work portion 12 relative to the base portion 14, and to ensure that motion of the first and second sides 25, 29 of the work portion 12 relative to the base portion 14 (in the second mode of operation) is substantially synchronous. Alignment of the work portion 12 relative to the base portion 14 and synchronous motion of the first and second sides 25, 29 of the work portion 12 relative to the base portion 14 may allow for the use of a single gas spring 26 as shown and previously described.

Operation of the assembly 10 will now be described with reference to the figures. As illustrated in FIG. 1A, in a first position or mode of operation, the assembly 10 may be locked in a first operating position. With reference to FIG. 1B, in a second mode of operation, a user may engage the actuation mechanism 27, by pulling the handle 32, for example, to transition the lift mechanism 26 from the first mode of operation to the second mode of operation and cause the primary member 28 to translate relative to the secondary member 30. As the primary member 28 translates relative to the secondary member 30, the work portion 12 may move relative to the base portion 14. In particular, the carriages 74*a*, 74*b* may translate relative to the tracks 72*a*, 72*b* along the longitudinal axes A3, A4, A5, A6, such that the work portion 12 moves relative to the base portion 14 in a direction substantially parallel to the longitudinal axes A3, A4, A5, A6. In one mode of operation, the work portion 12 may move relative to the base portion 14 along the longitudinal axes A3, A4, A5, A6 toward the ground (e.g., to lower the work portion 12), and in another mode of operation, the work portion 12 may move relative to the base portion 14 along the longitudinal axes A3, A4, A5, A6 away from the ground (e.g., to raise the work portion 12). Once the work portion 12 has moved to a desired location, the user may disengage the actuation mechanism 27, by releasing the handle 32, for example, to transition the lift mechanism 26 from the second mode of operation to the first mode of operation and fix the position of the primary member 28 relative to the secondary member 30 and the work portion 12 relative to the base portion 14.

As the work portion 12 translates relative to the base portion 14, the teeth 90*a*, 90*b* of the pinions 86*a*, 86*b* engage the teeth 84*a*, 84*b* of the racks 78*a*, 78*b* as the pinions 86*a*, 86*b* rotate with the axle 82 about the axis A10, helping to ensure alignment of the work portion 12 relative to the base portion 14. For example, engagement of the pinions 86*a*, 86*b* with the racks 78*a*, 78*b* can help to ensure that the work surface 22 maintains a constant orientation (e.g., horizontal orientation) relative to the base portion 14. In the event the user desires to change the orientation of the work portion 12 (e.g., work surface 22) relative to the base portion 14, the user can disengage the second locking feature 116 from the first locking feature 108 by, for example, pushing and removing the detent portion 127 from the first locking feature 108, and pulling the handle 118 to translate the plunger 94 and disengage one or both of the pinions 86 from the corresponding rack 78*a*, 78*a*.

The configuration of the assembly 10 described herein, including, for example, the configuration and cooperation of the lift assembly 16, the guide assembly 18, and the alignment assembly 20, can allow a user to easily and efficiently change and secure the position of the work portion 12 relative to the base portion 14. For example, in some implementations, the assembly 10 includes the lift mechanism 26, the first and second carriages 74*a*, 74*b*, the first and second tracks 72*a*, 72*b*, the first and second racks 78*a*, 78*b*, and the first and second pinion subassemblies 80*a*, 80*b* to allow for synchronous movement and support of the work portion 12 relative to the base portion 14.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A height-adjustable work surface assembly operable to adjust a position of a work surface relative to a vertical direction, the assembly comprising:

a base portion;

a work portion supported by the base portion and translatable along a first path of motion;

a gas spring operable in a first mode of operation and a second mode of operation, the gas spring operable to apply a force on the work portion in the second mode of operation to urge the work portion along the first path of motion;

an actuation mechanism operably coupled to the gas spring to selectively transition the gas spring from the first mode of operation to the second mode of operation;

a rack supported by one of the work portion or the base portion, the rack including a first plurality of teeth; and a pinion supported by the other of the work portion and the base portion, the pinion including a second plurality of teeth configured to engage the first plurality of teeth, wherein the first path of motion defines an angle greater than zero degrees relative to the vertical direction.

2. The assembly of claim 1, wherein the base portion includes a primary track member and the work portion includes a secondary track member supported for translation relative to the primary track member along the first path of motion.

3. The assembly of claim 1, wherein the angle is less than forty-five degrees.

4. The assembly of claim 3, wherein the angle is equal to five degrees.

5. The assembly of claim 1, wherein the actuation mechanism includes a handle translatably coupled to the work portion.

6. The assembly of claim 5, wherein the actuation mechanism includes a cable assembly operably coupled to the handle and the gas spring.

7. The assembly of claim 6, wherein the cable assembly includes a housing and a cable translatably disposed within the housing, and wherein the actuation mechanism includes a mounting member having an aperture, the cable translatably disposed within the aperture.

8. The assembly of claim 1, wherein the gas spring is pivotally coupled to the base portion and the work portion.

9. The assembly of claim 1, wherein the pinion is rotatably coupled to the other of the work portion and the base portion.

10. The assembly of claim 9, further comprising a tensioner including a housing and a plunger, the plunger supported by the housing and translatable along a second path of motion relative to the housing.

11. The assembly of claim 10, wherein the second path of motion is offset from the first path of motion.

12. The assembly of claim 10, wherein the pinion is rotatably coupled to the plunger.

13. The assembly of claim 10, wherein the plunger includes a base portion and a button portion biasingly supported by the base portion, and wherein the housing defines an aperture configured to receive the button portion to prevent translation of the plunger relative to the housing along the second path of motion.

14. A height-adjustable work surface assembly operable to adjust a position of a work surface relative to a vertical direction, the assembly comprising:

a base portion;

a work portion supported by the base portion;

a primary track member coupled to one of the work portion or the base portion;

a secondary track member coupled to the other of the work portion and the base portion and translatable relative to the primary track member along a first path of motion;

a gas spring operable in a first mode of operation and a second mode of operation, the gas spring operable to apply a force on the work portion in the second mode of operation to urge the work portion along the first path of motion; and an actuation mechanism operably coupled to the gas spring to selectively transition the gas spring from the first mode of operation to the second mode of operation, wherein the first path of motion extends in a direction offset from the vertical direction.

15. A height-adjustable work surface assembly operable to adjust a position of a work surface relative to a vertical direction, the assembly comprising:

a base portion;

a work portion supported by the base portion;

a primary track member coupled to one of the work portion or the base portion;

a secondary track member coupled to the other of the work portion and the base portion and translatable relative to the primary track member along a first path of motion;

a rack supported by one of the work portion and the base portion, the rack including a first plurality of teeth; and a pinion supported by the other of the work portion or the base portion, the pinion including a second plurality of teeth configured to engage the first plurality of teeth, wherein the first path of motion extends in a direction offset from the vertical direction.

16. The height-adjustable work surface assembly of claim 15, further comprising:

a gas spring operable in a first mode of operation and a second mode of operation, the gas spring operable to apply a force on the work portion in the second mode of operation to urge the work portion along the first path of motion; and an actuation mechanism operably coupled to the gas spring to selectively transition the gas spring from the first mode of operation to the second mode of operation.

17. The height-adjustable work surface assembly of claim 15, wherein the pinion is translatably coupled to the other of the work portion and the base portion.

18. A rack and pinion assembly comprising:

a rack including a first plurality of teeth; and a tensioner subassembly including:

a housing having a channel and a first locking feature;

a plunger translatably disposed within the channel and having a second locking feature configured to engage the first locking feature; and a pinion rotatably coupled to the plunger and having a second plurality of teeth configured to engage the first plurality of teeth.

19. The assembly of claim 18, wherein the second locking feature includes a moveable button, and wherein the first locking feature defines an aperture configured to receive the button to prevent translation of the plunger relative to the housing.

20. A height-adjustable work surface assembly comprising the rack and pinion assembly of claim 18, the height-adjustable work surface assembly further comprising:

a base portion; and a work portion supported by the base portion and translatable along a first path of motion, wherein the rack is supported by one of the work portion or the base portion, and the tensioner subassembly is supported by the other of the work portion and the base portion, and wherein the first path of motion extends in a direction offset from a vertical direction.

21. A method of assembling a height-adjustable work surface assembly, the method comprising:

coupling a primary track member to a secondary track member, the primary track member coupled to one of a work portion or a base portion of the height-adjustable work surface assembly and translatable relative to the secondary track member along a first path of motion, the secondary track coupled to the other of the work portion or the base portion of the height-adjustable work surface assembly;

engaging a first pinion with a first rack, the first pinion supported by the work portion, the first rack supported by the base portion; and engaging a second pinion with a second rack, the second pinion supported by the work portion, the second rack supported by the base portion, wherein the first path of motion defines an angle greater than zero degrees relative to a vertical direction.

22. The method of claim 21, wherein engaging the first pinion with the first rack includes engaging a plurality of pinion teeth with a plurality of rack teeth.

23. The method of claim 21, wherein engaging the first pinion with the first rack and engaging the first pinion with the first rack occur substantially simultaneously.

24. The method of claim 21, wherein engaging the first pinion with the first rack includes translating the first pinion relative to the first rack along a second path of motion offset from the first path of motion.

25. The method of claim 21, wherein the first pinion is supported for translation by a first housing, the method further comprising unlocking the first pinion relative to the first housing.

* * * * *